US008074665B2

(12) United States Patent
Pires et al.

(10) Patent No.: US 8,074,665 B2
(45) Date of Patent: Dec. 13, 2011

(54) COSMETICS CONTAINER

(75) Inventors: Leo Clifford Pires, Basking Ridge, NJ (US); Roger Hwang, Maple (CA); Iti Seth, New Delhi (IN); Rahul Bose, New Delhi (IN); Koushik Kohli, Uttar Pradesh (IN)

(73) Assignee: Zen Design Solutions Limited, Wanchai (HK)

( * ) Notice: Subject to any disclaimer, the term of this patent is extended or adjusted under 35 U.S.C. 154(b) by 671 days.

(21) Appl. No.: 11/944,589

(22) Filed: Nov. 23, 2007

(65) Prior Publication Data

US 2009/0133711 A1 May 28, 2009

(51) Int. Cl.
*A45D 33/00* (2006.01)

(52) U.S. Cl. ..... 132/293; 401/122; 401/118

(58) Field of Classification Search ..... 132/293–307, 132/317, 318; 401/119, 130, 125, 118, 124, 401/12, 121–122, 126–129
See application file for complete search history.

(56) References Cited

U.S. PATENT DOCUMENTS

| | | | | |
|---|---|---|---|---|
| 6,883,990 | B2 | 4/2005 | Shih | |
| 7,607,441 | B2 * | 10/2009 | Hrymoc | 132/218 |
| 2005/0092343 | A1 | 5/2005 | Byun | |
| 2005/0196219 | A1 * | 9/2005 | Habatjou | 401/127 |
| 2006/0239753 | A1 | 10/2006 | Hrymoc | |

* cited by examiner

*Primary Examiner* — Todd Manahan
*Assistant Examiner* — Brianne O'Neill
(74) *Attorney, Agent, or Firm* — Patterson & Sheridan, LLP

(57) ABSTRACT

A cosmetics container for storing and applying a cosmetic product is provided. In one embodiment, a cosmetics container includes a container body having an opening and a double walled cavity and a cap wherein the cap accommodates an applicator by way of a biasing means wherein said applicator includes a rod and an applicator element connected to a first end of the rod, and wherein said double walled cavity is closed by the rod when the applicator is mounted on the container.

10 Claims, 4 Drawing Sheets

COSMETICS CONTAINER

BACKGROUND

1. Field of the Invention

Embodiments of the present invention generally relate to a container for powder cosmetic products. More particularly, it relates to a cosmetics container that provides for a leakproof storage and ease of application of a powder cosmetic product. The container comprises a freely rotatable telescopic applicator that is integral with the cap and said container with a double walled cavity is having a non-circular aperture inside, which is plugged by the rod of the applicator element. Further, the cap of the container is capable of securely fitting onto the neck of the container by way of threads in the cap, thereby providing a leaktight storage and convenient use thereof.

2. Description of the Related Art

Cosmetic containers for powder cosmetics are known which generally include a container for holding the product having a wiper element in which sits the applicator in the form of a brush formed by a handle carrying a tuft of bristles. The container is provided with an additional cap to be screwed on to the container. Also, the applicator is of the size of the container which is generally small and is therefore inconvenient in application. Such a container has inconvenience in using as it consumes a lot of time by the time the product is ready to be applied. The shortcomings include time consumption in shaking the container, separating the cap from the case and then withdrawing the brush, possibility of misplacing the cap or the applicator if the package is left in disassembled state after completion of its use. Moreover, when the device is shaken, it is possible for powder to escape from the inside of the container to be deposited around the brush handle, inside the cap. The user's fingers are then soiled with product when he/she grasps the handle.

There have been proposed improvements over the aforementioned containers to overcome the shortcomings of the conventional case for powder cosmetics. For example United States Patent Application Publication No. 2005/0092343 discloses a cosmetics case for storing color cosmetics in powder state. The disclosed cosmetics case includes a cosmetic aid covered with powdery cosmetics and capable of being fixed to or released from a case body to be freely used by turning a cover of the cosmetics case to the right and left directions within a range of 90 degree angles. Although the case can eliminate the inconvenience caused due to loss of the cover in conventional products, the problem of the user's fingers getting soiled with the product still remains. Moreover, if the user forgets to rotate the cover to lock the container, the problem of leakage still exists.

United States Patent Application Publication No. 2006/0239753 discloses a device for packaging and applying a product that includes a container holding the product to be applied in loose powder form, the container having an opening. The device also includes an applicator including a rod, an applicator element at a first end of the rod, and a grasping portion connected to a second end of the rod. The applicator is configured to be attached by snapping onto the container so as to accommodate the applicator element in the container. However, as the cap is not screwed onto the container, the chances of leakage and the user's hands getting soiled during use still exist.

Also known are various containers wherein telescopic applicators are fixed to the caps of the containers in a spring-biased manner, however, the length of the rod of such telescopic applicators extends to bottom of the container such that the applicator element touches the bottom of the container in order to securely close the container. The drawback associated with such an arrangement is that there is a possibility of the applicator getting damaged with usage as the applicator is always under strain when in a closed position. For example, U.S. Pat. No. 6,883,990 discloses a cosmetics container comprising a hollow container and a cover unit. The cover unit covered on the upper end of the hollow container is composed of a connecting cover, a brush, a revolving base and a revolving cover, with the brush positioned in the connecting cover. While using, the revolving cover is to be turned around to move forward together with the revolving base and actuate the brush to move forward together and extend out of the cover unit for use.

Although many of these prior art containers are relevant with respect to the present invention, most of these containers disclose that the applicator tip sits into the wiper element and thus there is a possibility of the applicator being damaged in further uses as the applicator is always under strain. Moreover, the aforementioned products have been unable to provide the user with a container that allows an easy and convenient storing and applying of a powder cosmetic product. Also, when the applicator is integrally attached to the cap and the applicator plugs into the wiper element, it is necessary that the applicator and the wiper be circular in cross section so as to allow the cap to be screwed onto the container. Otherwise, the cap has to snap fitted on the container which again has the shortcoming of not being a leak proof closing for a container storing powder cosmetics.

Therefore, there is a need in the art for a container for powder cosmetics container that overcomes the shortcomings of the known containers. It is also desirable that the container provides ease of storage and application of the product.

SUMMARY

The present invention generally is a container for storing and applying a cosmetic product. The container provides for a leakproof storage and ease of application of the powder cosmetic product by providing a container comprising a double walled cavity and a cap which accommodates a telescopic applicator.

According to an embodiment of the invention, the container comprises a container body and a cap. The container body comprises a double walled cavity and an opening while the cap is having an applicator as its integral part. The applicator is telescopic and includes a rod, an applicator element at a first end of the rod, and a cap connected to the second end of the rod. The cap may be configured to be attached by screwing onto the container so as to accommodate the applicator element in the container. Also, the shape of the cap is designed in a manner such that it promotes maximum comfort grip for using the applicator.

According to an embodiment of the invention the applicator rod is connected to the cap in a way so as to be relatively rotatable thereto about their common longitudinal axis. This arrangement of the rod to the cap permits rotation of the cap for threading and unthreading from the container.

According to another embodiment of the invention the double walled cavity acts as a sheath for the applicator element. The double walled cavity tapers towards the bottom of the container thereby providing an aperture. The aperture thus formed is free to have a circular or an irregular cross section. Further, the aperture is formed in a shape to correspond to the shape of the applicator rod and applicator element. The applicator rod closes the aperture when the cap is screwed on the container thereby making it leakproof. Furthermore, the tip of the applicator element is protected from damage as the applicator rod fits into the aperture and keeps the applicator from being pushed down or resting on its head or tip.

According to yet another embodiment of the invention, the applicator rod is telescopic thereby providing ease of application to the user. Also, the telescopic applicator is capable of being used in a compact container.

According to yet another embodiment of the invention the container provides for double sealing of the product inside the container as the applicator rod plugs the aperture of the double walled cavity and the cap is capable of screw fitting even when the applicator rod has an irregular cross section. Therefore, the powder product is securely stored in the container by the double sealing action provided by the container so formed.

According to yet another embodiment of the invention, the container can have a plugged base, the base being capable of attachment to the container by snap action.

According to yet another embodiment of the invention, the container can be, advantageously, transparent thereby enabling the consumer to see the product from the outside and in particular its color.

According to yet another embodiment of the invention, the cosmetic product stored in the container could be a loose powder, baked or pressed product, in particular an eye shadow, rouge, a blusher or a foundation.

According to yet another embodiment of the invention there is provided an easy and convenient application of a powder cosmetic product where the user is getting a leaktight container with a screw cap and a telescopic applicator for ease of application of the powder product. Moreover, since the cap is screw fitted and as the applicator is attached to the cap itself, the user does not need to worry about the loss of the cap or of the fingers getting soiled with the product.

These and further aspects which will be apparent to one skilled in the art are attained by a container for powder cosmetic products in accordance with the claims below.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
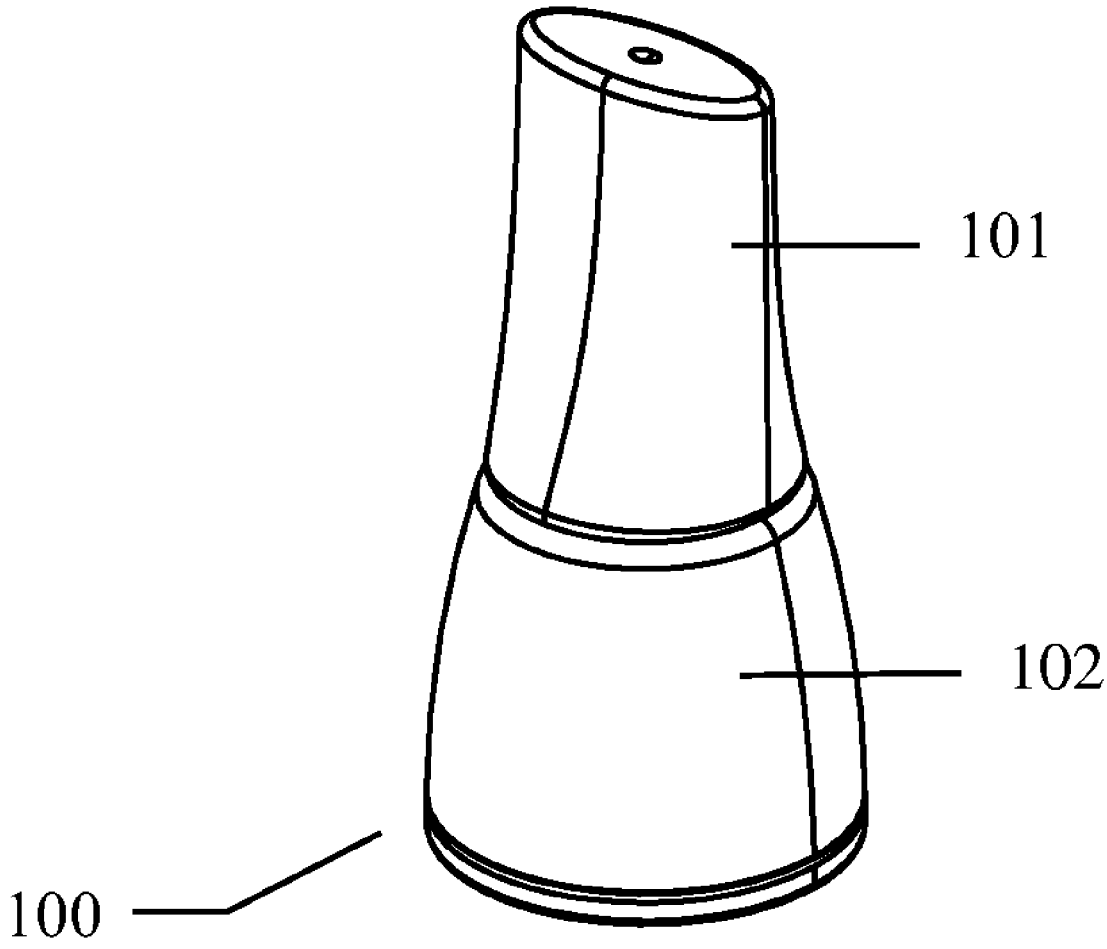
FIG. 1 illustrates an isometric view of the cosmetic container according to one embodiment of the present invention.

To facilitate understanding, identical reference numerals have been used, where possible, to designate identical elements that are common to the Figures. It is to be noted, however, that the appended drawings illustrate only typical embodiments of this invention and are therefore not to be considered limiting of its scope, for the invention may admit to other equally effective embodiments.

DETAILED DESCRIPTION

The cosmetic container according to one embodiment of the present invention is shown in FIGS. 1 to 4.

Figure 2:
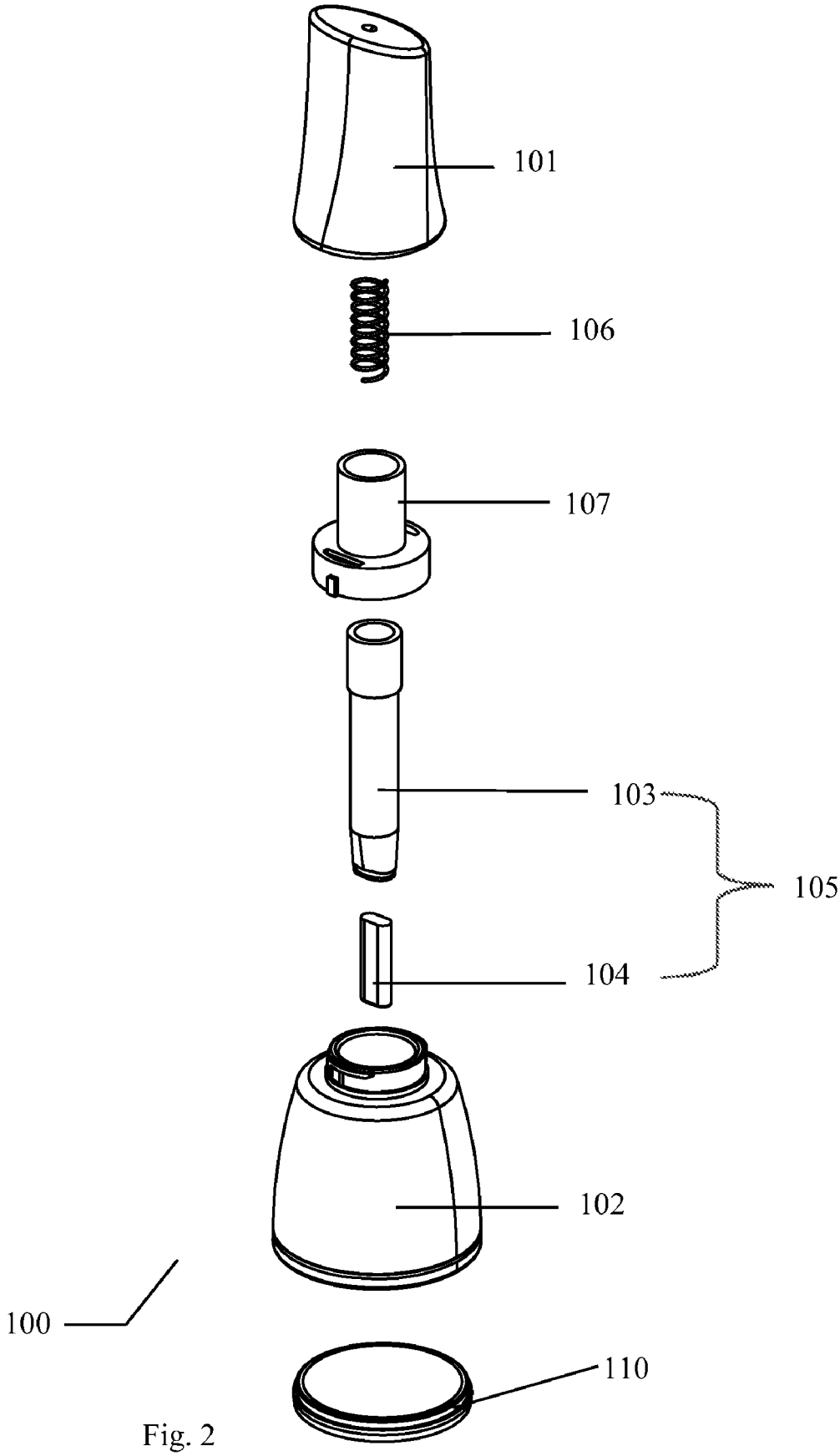
FIG. 2 illustrates an exploded view of the cosmetic container as shown in FIG. 1.
Figure 3:
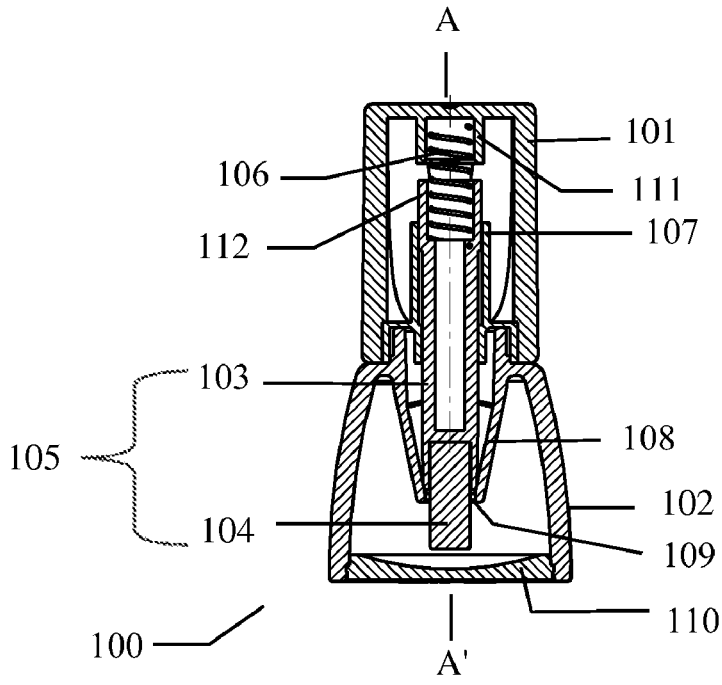
FIG. 3 is front cross sectional view of the cosmetic container taken along the line A-A' of FIG. 1.
Figure 4:
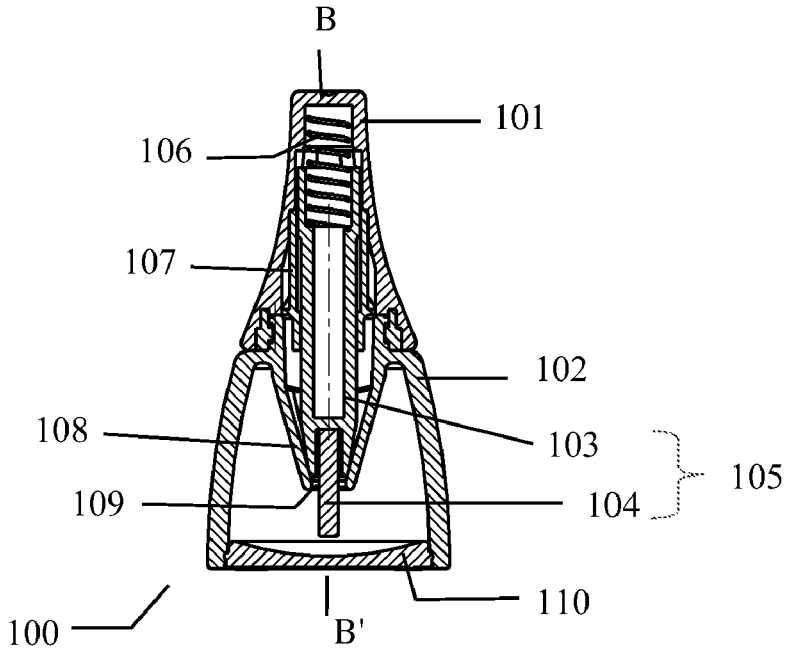
FIG. 4 is side cross sectional view of the cosmetic container taken along the line B-B' of FIG. 1.

FIG. 1 is one embodiment of the present invention showing the container 100. The cosmetic container 100 comprises a cap 101 and a container body 102 for holding/storing the product. The container body 102 may be formed from any suitable material or a polymeric material such as PCTA which is copolyester of cyclohexanedimethanol and purified terephthalic Acid. The cap 101 may be formed from any suitable material or a polymeric material such as polypropylene, acrylonitrile butadiene styrene or styrene acrylonitrile or any other suitable material. As shown in FIGS. 2 to 4, the cap 101 accommodates an applicator 105 inside it. The applicator 105 includes an applicator rod 103 and an applicator element 104 fitted at a first end of the rod 103. The applicator rod 103 may be formed of any suitable material or a polymeric material such as acrylonitrile butadiene styrene. The applicator rod 103 is secured in the cap 101 by way of a biasing means so as to be able to move axially longitudinally between a position inside the cap 101 to a position outside the cap 101. The biasing means may comprise a spring 106 for pushing the applicator rod 103 to its position outside the cap 101 when the cap 101 is removed. A first end of the spring is supported in a cavity 111 proximate the closed end of cap 101 and a second end sits in the cavity 112 in the applicator rod 103. An inner cap 107 is provided that accommodates the spring 106 and the applicator rod 103 in place, thereby making the applicator rod 103 relatively rotatable with respect to the cap 101. The relative rotation is achieved by the applicator rod 103 not being directly attached to the cap 101. The inner cap 107 may be formed from any suitable material or a polymeric material such as acrylonitrile butadiene styrene while the spring 106 may be made of spring steel or a specially molded plastic spring or any other suitable material.

FIGS. 3 and 4 depict an embodiment of the container body 102. The container body 102 comprises a double walled cavity 108. The double walled cavity 108 tapers towards the bottom of the container 102 thereby providing an aperture 109. The aperture 109 is formed in a shape to correspond to the shape of the applicator rod 103 and applicator element 104. The aperture 109 may be made to have a circular or an irregular cross section. In use, the aperture 109 gets plugged by the applicator rod 103 when the cap 101 is screwed on the container body 102 thereby making it leakproof. This cavity 108 also acts as a sheath for the applicator 105 and the tip of the applicator element 104 is protected from damage as it is the applicator rod 103 that fits into the aperture.

The container body 102 further includes a fitted base 110, which is for example snapped onto the body of the container 102. The base 110 may be formed of a polymeric material such as polypropylene.

Figure 5:
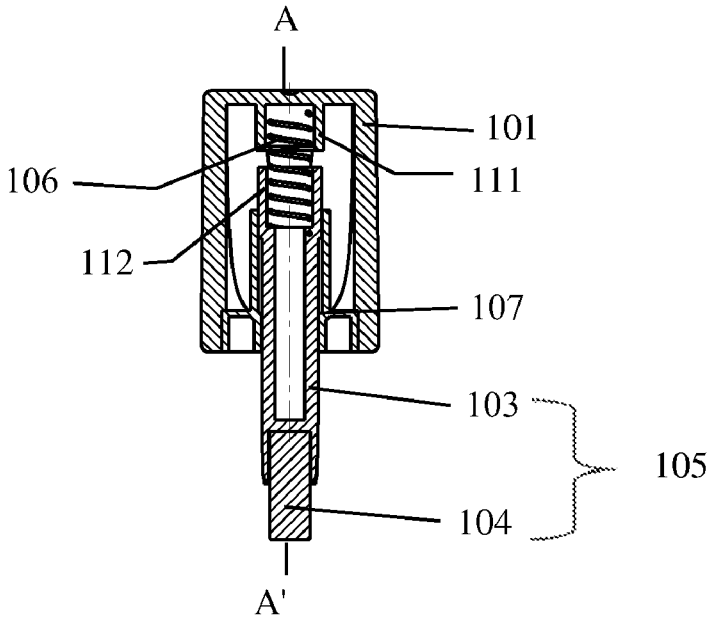
FIG. 5 is front cross sectional view of the cap and applicator rod assembly of the cosmetic container taken along the line A-A' of FIG. 1.
Figure 6:
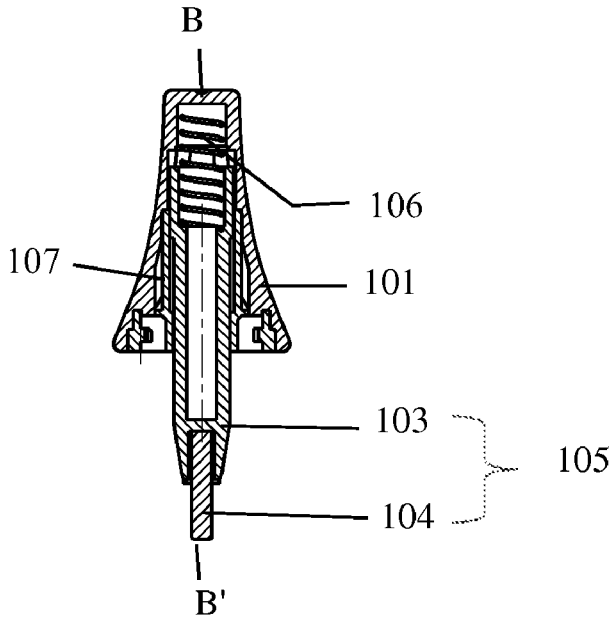
FIG. 6 is the side cross sectional view of the cap and applicator rod assembly of the cosmetic container taken along the line B-B' of FIG. 1.

With reference to FIGS. 5 and 6, the applicator rod 103 is further constructed to have a circular cross section at the top which tapers towards its bottom end where the applicator element 104 is snap fitted. This construction of the applicator rod 103 ensures accommodation of an applicator element 104 having an irregular cross-section. Such an arrangement of the rod 103 to the cap 101 permits rotation of the cap 101 for threading and unthreading from the container 102.

Depending upon the cosmetic material being used, a variety of sizes and shapes of the applicator can be utilized. The applicator element 104 may be constructed of a porous or non-porous rubber, fabric mesh, felt material, foamed polymers, sponge material or any other suitable material. Also, the applicator element 104 could have any suitable shape depending on the kind of application required. It could have a shape other than round such as flattened brushes on the end of the applicator rod.

Various examples of the cosmetic powder products where the container 100 of the present invention could be used are but not limited to an eye shadow, rouge, a blusher or a foundation.

These and further aspects which will be apparent to one skilled in the art are attained by a container for powder cosmetic products in accordance with the main claim.

While the foregoing is directed to embodiments of the present invention, other and further embodiments of the invention may be devised without departing from the basic scope thereof, and the scope thereof is determined by the claims that follow.

What is claimed is:

1. A cosmetics container for storing and applying a cosmetic product comprising:

a container body having an opening and a double walled cavity, wherein said double walled cavity tapers towards the bottom of the container to provide an aperture having an irregular cross section; and a cap wherein the cap accommodates an applicator wherein said applicator includes a rod and an applicator element connected to a first end of the rod;

wherein said rod and said applicator element have a shape that corresponds to the shape of said irregular cross section aperture such that said aperture is sealed by the rod and prevents rotation of the rod relative to the container when the cap is mounted on the container; and wherein said cap is connected to the rod in a way such that said cap rotates relative to the rod during rotation of said cap for threading and unthreading from said container.

2. The cosmetics container of claim 1 further comprising an inner cap that accommodates a biasing means and the applicator rod in place.

3. The cosmetics container of claim 2, wherein said biasing means makes applicator rod to be telescopically slidable inside the cap.

4. The cosmetics container of claim 1 wherein said cap has threads in its inner diameter which correspond with the threads in the neck of the container body such for the cap to be screwed on to the container.

5. The cosmetics container of claim 4 wherein said applicator rod plugs the aperture when the cap is screwed on the container.

6. The cosmetics container of claim 4 wherein the tip of the applicator element is protected from damage as the applicator rod plugs the aperture.

7. The cosmetics container of claim 1 wherein said cosmetic product comprises loose powder, baked or pressed product, in particular an eye shadow, rouge, a blusher or a foundation.

8. The cosmetics container of claim 1 wherein the container provides for double sealing of the product inside the container thereby making the container leakproof.

9. The cosmetics container of claim 1 wherein the container can be, advantageously, transparent thereby enabling the consumer to see the product from the outside and in particular its color.

10. A cosmetics container for storing and applying a cosmetic product comprising:

a container body having an opening and a double walled cavity that tapers towards the bottom of the container to provide an aperture of irregular cross section, a plugged base; and a cap having threads in its inner diameter which correspond with the threads in the neck of the container body for the cap to be screwed on to the container wherein the cap accommodates an applicator and wherein said applicator includes a rod and an applicator element connected to a first end of the rod, wherein said rod and said applicator element has a shape that corresponds to the shape of said irregular cross section aperture such that said aperture is sealed by the rod and prevents the rod from rotating when the cap is mounted on the container; and wherein said cap is connected to the rod in a way such that said cap rotates relative to the rod during the rotation of said cap for threading and unthreading from said container.

* * * * *